US008943964B2

(12) United States Patent
Foerch et al.

(10) Patent No.: US 8,943,964 B2
(45) Date of Patent: Feb. 3, 2015

(54) POWDERING DEVICE FOR A PRINTING PRESS AND METHOD FOR OPERATING THE POWDERING DEVICE

(71) Applicant: Heidelberger Druckmaschinen AG, Heidelberg (DE)

(72) Inventors: Peter Foerch, Neustadt (DE); Claudius Haas, Steinach (DE); Markus Moehringer, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/942,013

(22) Filed: Jul. 15, 2013

(65) Prior Publication Data

US 2014/0013977 A1 Jan. 16, 2014

(30) Foreign Application Priority Data

Jul. 13, 2012 (DE) ..... 10 2012 014 398

(51) Int. Cl.
*B41F 35/00* (2006.01)
*B41F 23/00* (2006.01)
*B41F 23/06* (2006.01)

(52) U.S. Cl.
CPC ..... *B41F 23/00* (2013.01); *B41F 23/06* (2013.01)
USPC ..... 101/424.2; 101/419

(58) Field of Classification Search
USPC ..... 101/424.2
See application file for complete search history.

(56) References Cited

U.S. PATENT DOCUMENTS

| | | | | |
|---|---|---|---|---|
| 269,850 | A * | 1/1883 | Hadden | 222/200 |
| 3,238,919 | A * | 3/1966 | Meyer | 118/308 |
| 3,396,872 | A * | 8/1968 | Wheeler | 222/637 |
| 4,154,370 | A | 5/1979 | Mowbray et al. | |
| 4,515,105 | A * | 5/1985 | Danta et al. | 118/629 |
| 4,867,063 | A | 9/1989 | Baker et al. | |
| 6,591,751 | B2 | 7/2003 | Sugimoto | |
| 6,615,723 | B1 | 9/2003 | Haas | |
| 6,889,609 | B2 * | 5/2005 | Braun et al. | 101/483 |
| 7,208,045 | B2 * | 4/2007 | Platsch | 118/308 |
| 7,607,391 | B2 * | 10/2009 | Haas et al. | 101/424.2 |
| 7,942,096 | B2 | 5/2011 | Blaser et al. | |
| 8,746,870 | B2 * | 6/2014 | Furukawa et al. | 347/101 |

FOREIGN PATENT DOCUMENTS

| | | | |
|---|---|---|---|
| DE | 19836014 | A1 | 2/2000 |
| DE | 10361602 | A1 | 7/2005 |
| DE | 102005055111 | A1 | 5/2007 |
| DE | 60124968 | T2 | 9/2007 |

OTHER PUBLICATIONS

German Patent and Trademark Office Search Report Dated Mar. 8, 2013.

* cited by examiner

*Primary Examiner* — Anthony Nguyen
(74) *Attorney, Agent, or Firm* — Laurence A. Greenberg; Werner H. Stemer; Ralph E. Locher

(57) ABSTRACT

A powdering device for a printing press includes a metering roller and a manifold. A plurality of injectors are provided downstream of the manifold in a conveying direction of the powder. The powdering device is operable in accordance with a method in which a total powder stream is subdivided into partial powder streams that are subsequently separately mixed with compressed air to create powder/air streams.

7 Claims, 4 Drawing Sheets

POWDERING DEVICE FOR A PRINTING PRESS AND METHOD FOR OPERATING THE POWDERING DEVICE

CROSS-REFERENCE TO RELATED APPLICATION

This application claims the priority, under 35 U.S.C. §119, of German Patent Application DE 10 2012 014 398.2, filed Jul. 13, 2012; the prior application is herewith incorporated by reference in its entirety.

BACKGROUND OF THE INVENTION

Field of the Invention

The present invention relates to a powdering device for a printing press and a method for operating the powdering device.

Powdering devices such as the one described in U.S. Pat. No. 7,942,096 B2 are used to powder printed sheets to prevent wet ink from smearing adjacent printed sheets in a delivery stack.

The powdering devices include a row of nozzle heads that eject streams of powder and air to apply powder to the passing printed sheets. In order to create the powder/air streams, the powder needs to be mixed with compressed air and distributed to the nozzle heads.

Traditionally, that has been done by mixing powder and compressed air in a central injector and by subsequently splitting up the powder/air stream coming from the injector into a plurality of powder/air streams for the nozzle heads in a manifold.

Those prior art powdering devices include only a single injector, which is disposed upstream of the manifold as viewed in the conveying direction of the powder as described, for example, in U.S. Pat. No. 4,154,370, U.S. Pat. No. 4,867,063 and German Patent Application DE 198 36 014 A1, corresponding to U.S. Pat. Nos. 6,250,513 and 6,615,723.

A disadvantage of the prior art is that long hoses are required to connect the manifold and the nozzle heads. The extended length of the hoses is adverse to an accurately timed powdering cycle at a high cycle frequency, thus limiting the printing speed.

BRIEF SUMMARY OF THE INVENTION

It is accordingly an object of the invention to provide a powdering device for a printing press and a method for operating the powdering device, which overcome the hereinaforementioned disadvantages of the heretofore-known devices and methods of this general type and which are suited for higher printing speeds.

With the foregoing and other objects in view there is provided, in accordance with the invention, a method for operating a powdering device in a printing press, comprising the steps of dividing a total powder stream into partial powder streams, and subsequently mixing the partial powder streams with powder separately from each other to create powder/air streams.

With the objects of the invention in view, there is also provided a powdering device for a printing press, comprising a metering roller, a manifold, and a plurality of injectors disposed downstream of the manifold as viewed in a conveying direction of the powder.

The invention thus breaks with the established prior art principle inasmuch as the powder in the total powder stream is not yet mixed with compressed air. As a result, the manifold only distributes powder, i.e. powder without compressed air. The invention does without a central, single injector. Instead, a group of injectors is provided. Each of these injectors may be connected to a different nozzle head or to a different group of nozzle heads. These connections may be implemented by using relatively short tubes or hoses, thus permitting a high powdering cycle frequency and a correspondingly high printing speed.

Advantageous further developments of the powdering device of the invention will become apparent from the dependent claims and will be briefly explained below.

In accordance with another feature of the invention, that is advantageous in view of a direct take-up of the powder from the manifold by the metering roller, the injectors are disposed downstream of the metering roller as viewed in the conveying direction of the powder and the metering roller is disposed between the manifold and the injectors.

In accordance with a further feature of the invention, that is advantageous in view of powder conveying paths of equally short length from the metering roller into the injectors, the injectors are disposed in a row that is parallel to the metering roller.

In accordance with an added feature of the invention, that is advantageous in view of conveying the powder from the manifold to the metering roller due to gravity, the exits of the manifold open out onto the metering roller to be able to convey powder onto the metering roller through the exits.

In accordance with an additional feature of the invention, that is advantageous in view of creating strictly delimited metering zones on the metering roller, each of the exits is laterally delimited by elastic seals engaged with the metering roller.

In accordance with yet another feature of the invention, that is advantageous in view of avoiding a waste of powder when small sheet formats are being processed, the exits are disposed in a row and the exits located on the ends of the row are closable by a blocking device in order to be able to adjust the powdering width.

In accordance with yet a further feature of the invention, that is advantageous in view of powder conveying paths of equally short length between the metering roller and the nozzle heads, the length of the metering roller corresponds to at least half the printing format width of the printing press.

In accordance with yet an added feature of the invention, that is advantageous in view of a parallel connection of the injectors with each other, the injectors are connected to a common compressed-air source.

In accordance with a concomitant feature of the invention, that is advantageous in terms of a locally reinforced spraying at the lateral edges of the sheets to avoid a local shortage of powder in these regions, at least some of the exits of the manifold, namely the exits corresponding to the lateral edges of the sheets, are adjustable in terms of their respective powder passage cross sections.

The invention further envisages a sheet-fed printing press for lithographic or planographic offset printing, comprising a powdering device of the invention or a powdering device corresponding to one of the further developments described above.

Other features which are considered as characteristic for the invention are set forth in the appended claims.

Although the invention is illustrated and described herein as embodied in a powdering device for a printing press and a method for operating the powdering device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
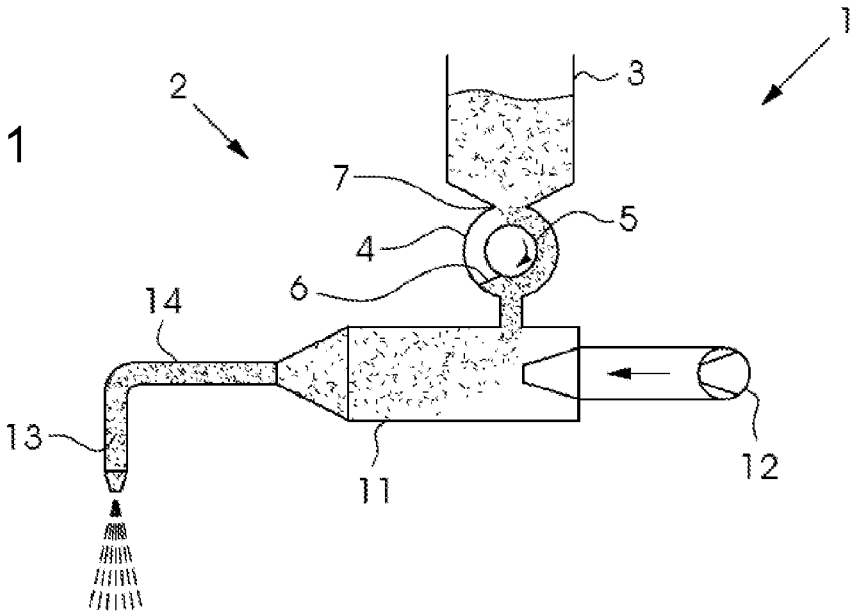
FIG. 1 is a fragmentary, diagrammatic, side-elevational view of a powdering device.

Referring now to the figures of the drawings in detail and first, particularly, to FIG. 1 thereof, there is seen a section of a printing press 1. The printing press 1 is a sheet-fed printing press for lithographic or planographic offset printing. The illustrated section includes a powdering device 2 provided in a sheet delivery of the printing press 1. The powdering device 2 is used to dust printed sheets that have just been printed in the printing press 1 with powder to act as a spacer material between the printed sheets lying on top of each other in the sheet stack of the sheet delivery. The powder is stored in a central powder supply container 3 with a funnel-shaped lower end connected to a housing 4. Due to the force of gravity, potentially assisted by a vibrating device, the powder slides through an opening at a bottom end of the container 3 and into the housing 4. The housing 4 contains a metering roller 5 and a doctor blade 6 engaged therewith to scrape excess powder off the metering roller 5.

Figure 2:
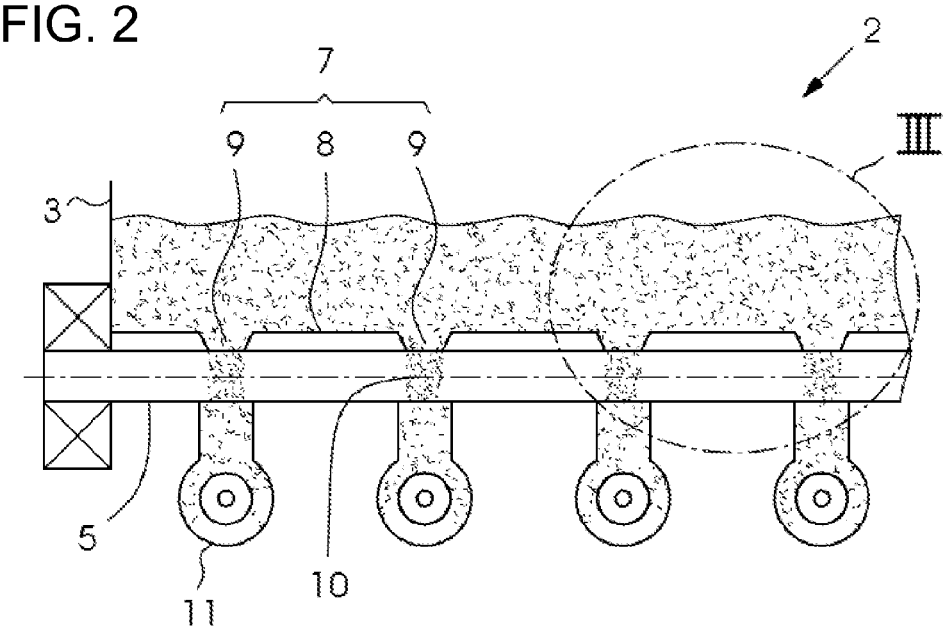
FIG. 2 is a fragmentary, longitudinal-sectional view of the powdering device.

FIG. 2 is a simplified sectional view of a manifold 7 disposed above the metering roller 5 in the housing 4. The manifold 7 is formed by a number of seals 8 and manifold exits 9 located therebetween. The powder, which is conveyed out of the exits 9 by the rotation of the metering roller 5 and forms powder pillars in the exits 9, forms strips 10 of powder on the circumferential surface of the metering roller 5. The doctor blade 6 scrapes the strips 10 of powder off the metering roller 5 to convey the powder metered out in the shape of the powder strips 10 into injectors 11. The injectors 11 are disposed in a row corresponding to the exits 9 so that a respective injector 11 is aligned with one of the exits 9 in the powder conveying direction. All of the injectors 11 are connected to a common compressed-air source 12, for example a compressor, by a common line system (see FIG. 2). Each injector 11 is connected to a different nozzle head 13 through a short line 14 to supply a powder/air mix to the nozzle head 13. In the injector 11, the powder from the respective strip of powder 10 is mixed with the compressed air that has been blown into the injector 11 from the compressed-air source 12 to create the powder/air mix. The powder/air streams flow from the injectors 11 to the nozzle heads 13 through the lines 14 and are ejected by the nozzle heads towards the printed sheets that pass the nozzle heads 13. The nozzle heads 13, only one of which is shown in FIG. 1, are disposed in a line perpendicular to the drawing plane of FIG. 1.

Figure 3:
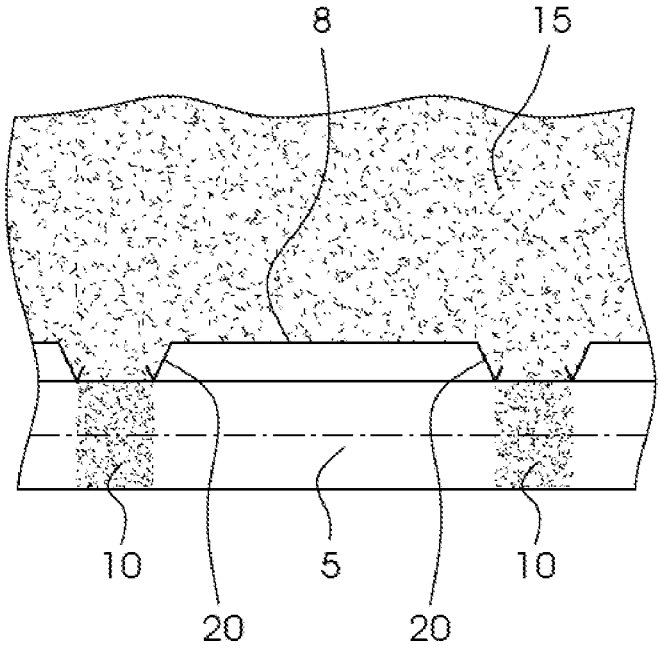
FIG. 3 is an enlarged, fragmentary, longitudinal-sectional view of a portion III of FIG. 2.

FIG. 3 illustrates a portion of FIG. 2 indicated by reference symbol III. It is apparent that each seal 8 has a substantially U-shaped cross-section and that the two legs of the U profile of each seal 8 form lip seals 20 that are in engagement with the circumferential surface of the metering roller 5 due to the flexibility of the seal 8. It is further apparent that a volume of powder 15 that has not yet been subdivided is located above the seals 8 and extends substantially across the entire length of the metering roller 5 in the shape of a powder pillar. This volume of powder 15 may be referred to as a total powder stream, whereas the powder strips 10 may be referred to as partial powder strips.

The lip seals 20 delimit the exits 9. The aforementioned powder pillars are located between the seals 8, i.e. in the exits 9.

Figure 4:
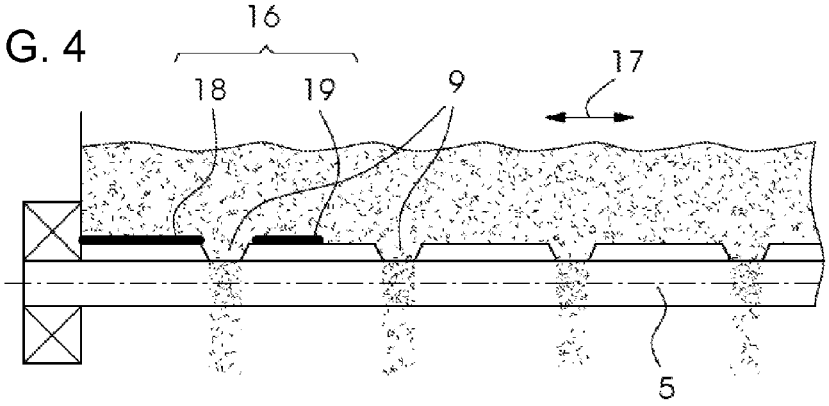
FIGS. 4-6 are fragmentary, longitudinal-sectional views illustrating various format settings of the powdering device.
Figure 5:
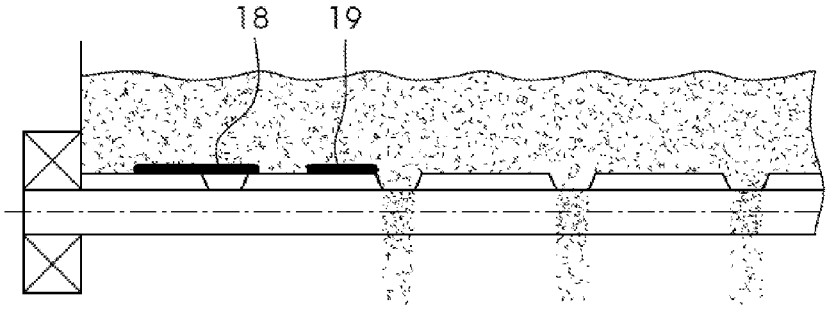
Figure 6:
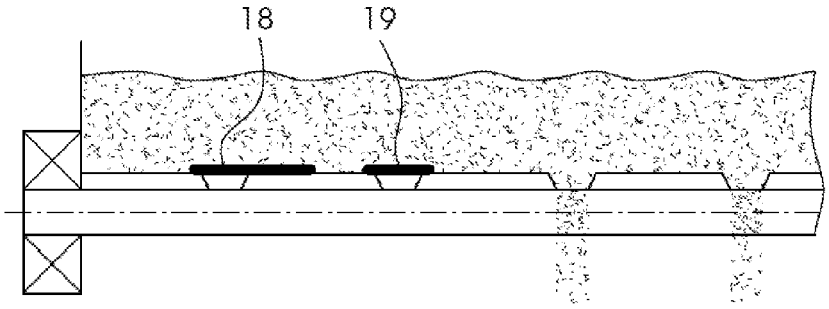

FIGS. 4 to 6 illustrate the manifold 7 equipped with a blocking device 16 for selectively blocking those exits 9 located at the two ends of the row. The blocking device 16 is disposed so as to be displaceable along the row of exits 9 in a direction 17 parallel to the axis of rotation of the metering roller 5. The blocking device 16 may be used to block the exits one after another, starting from the two ends of the row, to deactivate the nozzle heads 13 communicating with the exits 9 which are to be blocked if the latter are outside the respective format width of the printed sheets. Adapting the device to the sheet format by deactivating these nozzle heads 13 prevents the nozzle heads 13 from spraying powder laterally past the passing print sheets and thus prevents contamination of the environment.

FIGS. 4 to 6 merely illustrate one end of the powdering device by way of example. It is to be understood, however, that the blocking device 16 will work in the same way at the non-illustrated other end.

FIG. 4 illustrates a first position of the blocking device 16 wherein a cover 18 of the blocking device 16 does not yet cover the outermost, last exit 9 and a further cover 19 of the blocking device 16 does not yet entirely cover the adjacent, next to last exit 9.

FIG. 5 illustrates a second position wherein the cover 18 already covers the last, outermost exit 9 and the further cover 19 still does not yet cover the next to last exit 9.

FIG. 6 illustrates a third position wherein both covers 18, 19 cover the respective exits 9.

The position shown in FIG. 4 is used for powdering sheets of large format width, the position shown in FIG. 5 is used for sheets of medium format width, and the position shown in FIG. 6 is used for powdering sheets of small format width.

Figure 7:
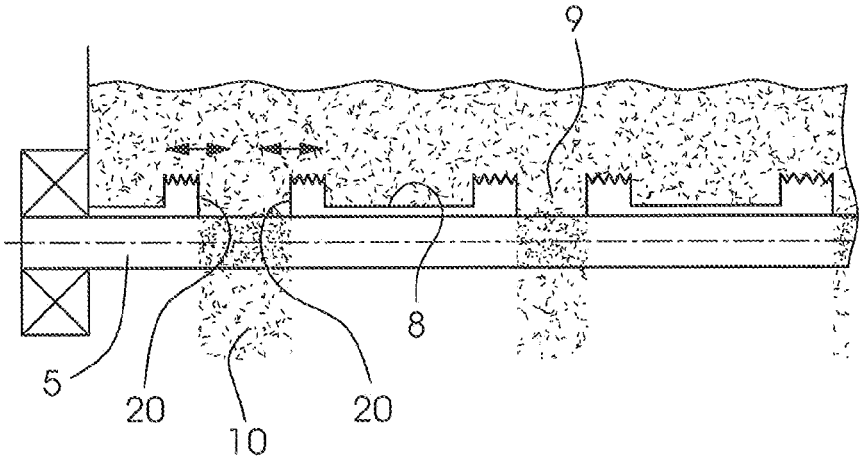
FIG. 7 is a fragmentary, longitudinal-sectional view illustrating a manifold setting of the powdering device.

FIG. 7 likewise illustrates only one end of the powdering device. Again, the other end works analogously. The cross-sections of the passages of the exits 9 are individually adjustable. For this purpose, the lip seals 20, which delimit the respective exit 9, are adjustable towards and away from each other, preferably by remote control and by motor. The adjustment is graphically indicated by the double-headed arrows. At least the exits 9 located at both ends of the row of exits 9 are adjustable. The exits 9 located further inward towards the center of the row do not need to be adjustable. An adjustment results in an adjustment or throttling of the flow rate of powder in the respective exit 9.

In the position shown in FIG. 7, the width and thus the cross-section of the passage of the outermost active exit 9, which may be the outermost non-blocked exit 9 (see FIG. 6), is set to be greater than those of the exits 9 located further inward. As a consequence, the strip of powder 10 ejected by this outermost exit 9 is wider and the amount of powder ejected by this exit 9 is greater. This greater amount of powder is directed to an outermost active nozzle head 13, which sprays powder onto an area located close to the lateral edge of the printed sheet. Experience has shown that this area tends to suffer from a shortage of powder, which is counteracted by an uneven powder distribution setting.

The invention claimed is:

1. A powdering device for a printing press, the powdering device comprising:

a metering roller;

a manifold conveying powder to said metering roller, said manifold having exits opening out onto said metering roller for subdividing a total powder stream into partial powder streams and configured for conveying powder onto said metering roller through said exits;

a multiplicity of injectors disposed downstream of said manifold in a powder conveying direction, said injectors being disposed downstream of said metering roller in the powder conveying direction, and said metering roller being disposed between said manifold and said injectors, and said injectors being mixing injectors for separately mixing said partial powder streams with compressed air to create powder/air streams; and nozzle heads for ejecting the powder/air streams towards a printed sheet.

2. The powdering device according to claim 1, wherein said injectors are disposed in a row being parallel to said metering roller.

3. The powdering device according to claim 1, which further comprises respective flexible seals engaged with said metering roller and laterally delimiting said exits.

4. The powdering device according to claim 1, wherein:

said exits are disposed in a row having two ends; and a blocking device is configured to close said exits located at both of said ends to adjust a powdering width.

5. The powdering device according to claim 1, wherein said metering roller has a length corresponding to at least half of a printing format width of the printing press.

6. The powdering device according to claim 1, which further comprises a common compressed-air source connected to said injectors.

7. The powdering device according to claim 1, wherein at least some of said exits have an adjustable passage cross section.

* * * * *